US005623745A

United States Patent [19]

Stanek

[11] Patent Number: 5,623,745

[45] Date of Patent: Apr. 29, 1997

[54] CARPET CUTTING SYSTEM

[76] Inventor: Michael Stanek, 304 Paseo Pinto, San Clemente, Calif. 92672

[21] Appl. No.: 590,816

[22] Filed: Jan. 24, 1996

[51] Int. Cl.[6] ..... A47L 5/28

[52] U.S. Cl. ..... 15/339; 15/354; 30/133; 83/169

[58] Field of Search ..... 15/339, 354; 83/168, 83/169; 30/133

[56] References Cited

U.S. PATENT DOCUMENTS

| | | | |
|---|---|---|---|
| 3,613,239 | 10/1971 | Porrelli | 30/133 |
| 3,678,579 | 7/1972 | Slavik | 30/133 |
| 4,788,769 | 12/1988 | Maruyama | 30/133 |
| 4,834,304 | 5/1989 | Uchida | 242/35.6 E |
| 4,985,999 | 1/1991 | Iwasaki et al. | 30/133 X |
| 5,210,996 | 5/1993 | Fassauer | 15/327.3 X |
| 5,361,453 | 11/1994 | Gerber | 15/309.1 X |
| 5,392,492 | 2/1995 | Fassauer | 15/327.3 |

*Primary Examiner*—Chris K. Moore

*Attorney, Agent, or Firm*—Patent & Trademark Services; Joseph H. McGlynn

[57] ABSTRACT

A carpet cleaning system which utilizes a conventional vacuum cleaner which is modified to include a cutting system. The vacuum cleaner raises the upper parts of the carpet material through suction and the cutting system cuts off the upper portion of the stained carpet. The vacuum removes the cut portion and what remains is clean carpet.

5 Claims, 1 Drawing Sheet

CARPET CUTTING SYSTEM

BACKGROUND OF THE INVENTION

This invention relates, in general, to a system for cleaning and maintaining carpets, and, in particular, to a vacuum cleaner having a cutter associated therewith which will cut away soiled areas or tangled, sticking and/or pulled out fibers of the carpet.

DESCRIPTION OF THE PRIOR ART

In the prior art various types of of cutters have been proposed for applications in a typical home. For example, U.S. Pat. No. 3,613,239 discloses a cutting tool for floor coverings such as linoleum. U.S. Pat. No. 3,678,579 discloses a device for cutting yarn which uses suction to draw yarn into an area where the end make be cut. U.S. Pat. No. 4,788,769 discloses an apparatus for severing pilled material from clothing. U.S. Pat. No. 4,834,304 discloses a yarn end finding device which includes a rotary cutter to cut off the end of the yarn.

SUMMARY OF THE INVENTION

The present invention relates to a system for replenishing the look of household carpet and helps to keep it looking new. Usually carpet will start to look soiled after years of use in a home. Beverages and food and other items are dropped on the carpet in every day use and soon the carpet looks old. Many commercial carpet cleaning solutions are available for washing carpet in order to remove the stains. Some of these include liquids which can be applied by hand, using a brush, which dissolve the stains. Other solutions include bulky machines which apply a cleaning solution and then remove the solution. However, these machines are difficult to operate and all the furniture in a room must be move, and sometimes, completely removed from the room being cleaned. This is a time consuming and difficult operation often requiring several people.

Most of the carpet cleaning systems utilize chemicals which shorten the life of the carpet. They are also expensive, detrimental to the environment and time consuming to apply. Also, they rarely remove all of the stains. The home owner, after much work and expense is usually left with stained carpet.

What most people do not realize is that stains on carpet are usually only on the upper most part of the material that makes up the carpet. If this upper portion of the carpet fibers is removed, the stains are also removed.

The present invention utilizes a conventional vacuum cleaner which is modified to include a cutting system. The vacuum cleaner raises the upper parts of the carpet material through suction and the cutting system cuts off the upper portion of the stained carpet. The vacuum removes the cut portion and what remains is clean, evenly straight and smooth carpet.

It is an object of the present invention to provide a carpet cleaning system which does not employ chemicals to clean the carpet.

It is an object of the present invention to provide an inexpensive carpet cleaning system that can be used by the average homeowner with simple every day use.

It is an object of the present invention to provide a carpet cleaning system which does not require extensive time and labor in order to clean household carpet.

It is an object of the present invention to provide a carpet cleaning system which leaves no fusses, no tangles, and no carpet fibers sticking out which makes vacuuming easier, more efficient because less power is required after cutting, since dirt is removed easier resulting in less resistance at the vacuum cleaner brushes.

It is an object of the present invention to provide a carpet cleaning system which does not pull out carpet fibers which can damage the carpet.

It is an object of the present invention to provide a carpet cleaning system which significantly reduces breaking up of loose, small carpet fiber particles, which can be dispersed into the air resulting in a detriment to allergy sufferers.

These and other objects and advantages of the present invention will be fully apparent from the following description, when taken in connection with the annexed drawings.

DESCRIPTION OF THE PREFERRED EMBODIMENT

Figure 3:
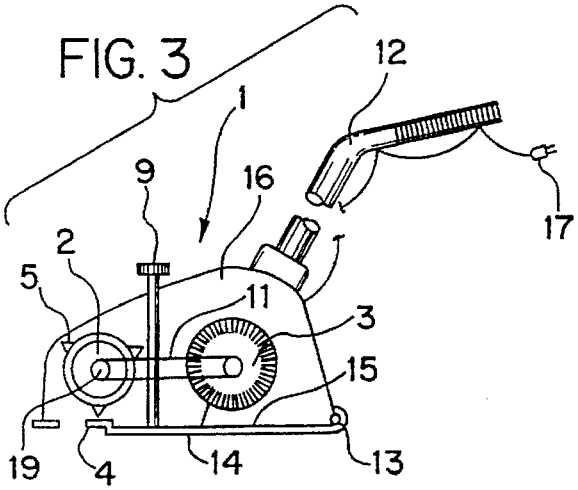
FIG. 3 is a partial side view of the present invention.

Referring now to the drawings in greater detail, FIG. 3 shows a partial side view with portions of the housing and parts of the vacuum mechanism removed to allow viewing of the internal mechanism. The invention 1 is incorporated into a conventional vacuum cleaner having a housing 16, a motor 3, wheels 10, a handle 12, electrical plug 17, and a beater brush 8, which operates in a conventional manner to dislodge dirt from the carpet so the vacuum can collect it. Since the vacuum part of the invention operates in the same manner as a conventional vacuum cleaner, the operation of the vacuum cleaner will not be described for the sake of brevity. However, it should be noted even though a particular type of vacuum cleaner is shown in the drawings, this is merely for illustration purposes. The present invention could be incorporated into any type of vacuum cleaner. Also, in FIG. 3 the vacuum bag, which collects the dirt picked up by the vacuum, has been eliminated for purposes of clarity.

Figure 1:
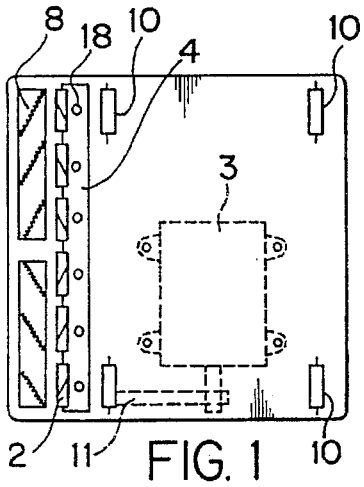
FIG. 1 is a view of the bottom of the present invention.
Figure 2:
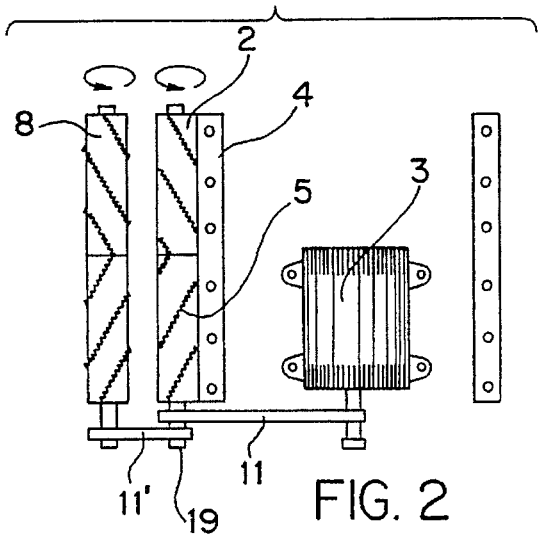
FIG. 2 is a top view of the present invention with the cover removed.

FIG. 1 shows the bottom of the vacuum cleaner after it has been modified to incorporate the present invention. Behind the conventional beater brushes 8 is mounted a cutting edge incorporated into a plate 4 which extends across the width of the bottom of the vacuum cleaner. The plate can be secured to the cleaner by any conventional means such as, but not limited to, screws 18. A shaft 19 (see also FIG. 3) is mounted between the beater brushes 8 and plate 4. Attached to this shaft is a rotary drum 2 mounting a plurality of cutting blades 5. The shaft will be connected to the motor 3 by a belt 11 (or conventional gears, not shown) which will turn the shaft in a counterclockwise direction (as seen in FIG. 3). The belt 11' is connected to the shaft 19 and to the shaft the brushes 8 are mounted on so the brushes can be rotated by the same motor as the shaft 9. Also, if desired a separate motor could be incorporated into the mechanism to rotate the brushes.

At the bottom of the vacuum 15 a hinged plate 14 is mounted by means of hinge 13. A height adjusting knob 9 which can be attached to housing 16 by any conventional means such as screw threads, will abut against plate 14. As the knob 9 is rotated it will advance into the housing 16 thereby pushing plate 14 away from housing 16. This will raise the vacuum away from the floor and the amount of carpet that is cut can be thereby varied.

The vacuum cleaner with the cutting system will be operated in the same manner as a conventional vacuum cleaner. However, as the vacuum is pushed across a carpeted surface, the rotating cutters 5 will pull the upper portions of the carpet fibers toward the cutting plate 4. Any portion of the carpet trapped between the rotating cutters 5 and plate 4, will be cut off and the cut pieces will be vacuumed up by the normal action of the vacuum cleaner.

Figure 4:
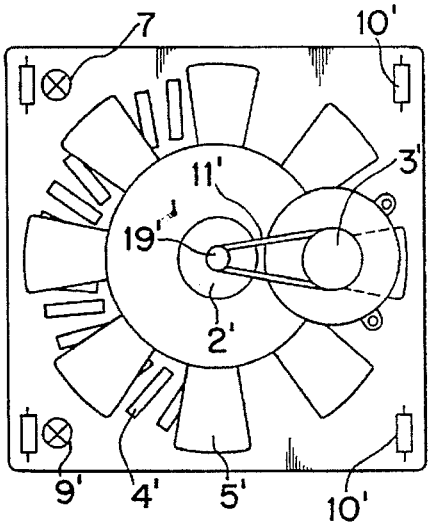
FIG. 4 is a top view, with the cover removed, of another embodiment of the present invention.
Figure 5:
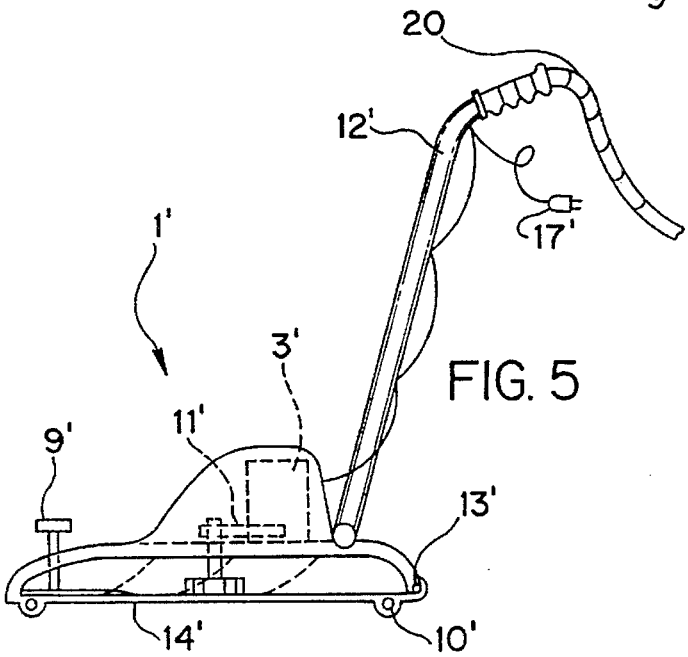
FIG. 5 is a side view of the other embodiment of the present invention.

FIGS. 4 and 5 show a second embodiment of the present invention in which the cutting system 1' is incorporated into a separate unit known as a power wand. In this embodiment common elements are referenced with the same reference numerals with the addition of a prime. FIG. 4 discloses a housing for the cutting system which has a motor 3', wheels 10', a handle 12' (see FIG. 5), and an electrical plug 17', all of which operate in the conventional manner. In addition, a vacuum hose 20 connects to the main vacuum cleaner to collect dirt and debris. Also, the power wand will have beater brushes (similar to the brushes 8 in FIG. 1) as is conventional in this type of attachment, however the brushes are not shown in FIGS. 4 and 5 for reasons of clarity.

The motor 3' is connected by a belt 11' to a shaft 19' to which the cutting blades 5' are connected. Unlike the cutting blades 5 in the first embodiment, the cutting blades 5' will rotate in a plane that is parallel to the floor on which the carpet is placed. The power wand will have openings 24 in the bottom of the housing beneath the rotating cutting blades 5'. As the vacuum sucks up the carpet fibers, they will be pulled through the openings and will be pinched between the cutting blades 5' and the edges of the openings 24, and cut off.

The power wand of FIGS. 4 and 5 will also have a height adjustment mechanism consisting of a plate 14' secured to the bottom of the wand by a hinge 13'. Adjustment knobs 9' will move the plate 14' toward the floor when they are turned clockwise, and when the knobs 9' are turned counterclockwise, the weight of the wand will force the plate upward in the same manner as the FIG. 1 embodiment.

Although the carpet cleaning system and the method of using the same according to the present invention has been described in the foregoing specification with considerable details, it is to be understood that modifications may be made to the invention which do not exceed the scope of the appended claims and modified forms of the present invention done by others skilled in the art to which the invention pertains will be considered infringements of this invention when those modified forms fall within the claimed scope of this invention.

What I claim as my invention is:

1. A carpet cleaning system comprising in combination a carpet vacuum cleaner having beater brushes, a motor for creating a vacuum, a handle for guiding the vacuum cleaner and wheels for allowing said vacuum cleaner to move over a carpeted surface, a plate having a cutting edge mounted adjacent said beater brushes, a rotating drum having cutting blades mounted adjacent said plate, means for rotating said drum, whereby as said drum rotates it pulls portions of said carpet toward said plate where said portions will be cut off and said cut off portions will be picked up by the vacuum of said vacuum cleaner.

2. The carpet cleaning system as claimed in claim 1, wherein said system includes means for adjusting the amount of carpet that will be cut.

3. The carpet cleaning system as claimed in claim 2, wherein said means for adjusting the amount of carpet that will be cut includes a plate mounted to a bottom portion of said vacuum cleaner by a hinge, means for moving a portion of said plate remote from said hinge which will raise or lower said plate having a cutting edge and said rotating drum whereby the amount of carpet that will be cut can be varied.

4. The carpet cleaning system as claimed in claim 1, wherein said system wherein said cutting blades are mounted in a separate housing, said housing is mechanically attached to said vacuum cleaner.

5. The carpet cleaning system as claimed in claim 1, wherein said blades rotate in a plane which is parallel to said carpet.

* * * * *